US006045293A

United States Patent [19]

Dickinson

[11] Patent Number: 6,045,293

[45] Date of Patent: Apr. 4, 2000

[54] DRIVER INTIMIDATING PERSON FRIENDLY TIRE DESTRUCTIVE TRAFFICWAY CONTROLLER

[76] Inventor: Harry D. Dickinson, @Delta Scientific, 24901 W. Ave. Stanford, Valencia, Calif. 91355

[21] Appl. No.: 09/032,301

[22] Filed: Feb. 27, 1998

[51] Int. Cl.[7] ..... E01F 13/12

[52] U.S. Cl. ..... 404/6; 256/1; 49/49

[58] Field of Search ..... 49/33, 49, 131; 256/1, 13.1; 404/6, 9, 11

[56] References Cited

U.S. PATENT DOCUMENTS

| | | | |
|---|---|---|---|
| Re. 35,373 | 11/1996 | Kilgrow et al. | 404/6 |
| 922,165 | 5/1909 | Lee . | |
| 1,518,616 | 12/1924 | Varnell et al. . | |
| 1,527,107 | 2/1925 | Allen . | |
| 2,403,014 | 7/1946 | Nampa | 39/6 |
| 3,325,782 | 6/1967 | Der | 340/31 |
| 3,783,558 | 1/1974 | Keator | 49/49 |
| 4,016,679 | 4/1977 | Ellefson | 49/49 |
| 4,097,170 | 6/1978 | Dickinson | 404/6 |
| 4,158,514 | 6/1979 | Dickinson | 404/6 |
| 4,318,079 | 3/1982 | Dickinson | 340/127 |
| 4,354,771 | 10/1982 | Dickinson | 404/6 |
| 4,544,303 | 10/1985 | Glasmire | 404/6 |
| 5,288,164 | 2/1994 | Nasatka | 404/10 |
| 5,498,102 | 3/1996 | Bissell | 404/6 |
| 5,507,588 | 4/1996 | Marts et al. | 404/6 |
| 5,588,774 | 12/1996 | Behan | 404/6 |
| 5,775,832 | 7/1998 | Kilgrow et al. | 404/6 |
| 5,820,293 | 10/1998 | Groen et al. | 404/6 |

*Primary Examiner*—James A. Lisehora
*Attorney, Agent, or Firm*—William H. Maxwell

[57] ABSTRACT

A vehicle trafficway controller characterized by a person friendly driver intimidating wrong-way traffic condition for causing vehicle tire tread damage, having a vertically extensible tire tread piercing member shiftably carried by a frame and with a retractile tread piercing point, and a movable person protective cover isolating said point when in said person friendly driver intimidating wrong-way traffic condition, and exposing said tire tread piercing point to a tire tread rolling thereover, the tire tread piercing member being frangible and/or extended and retracted.

24 Claims, 6 Drawing Sheets

1
2
3
4
5
30
A
C
14

FIG. 13.
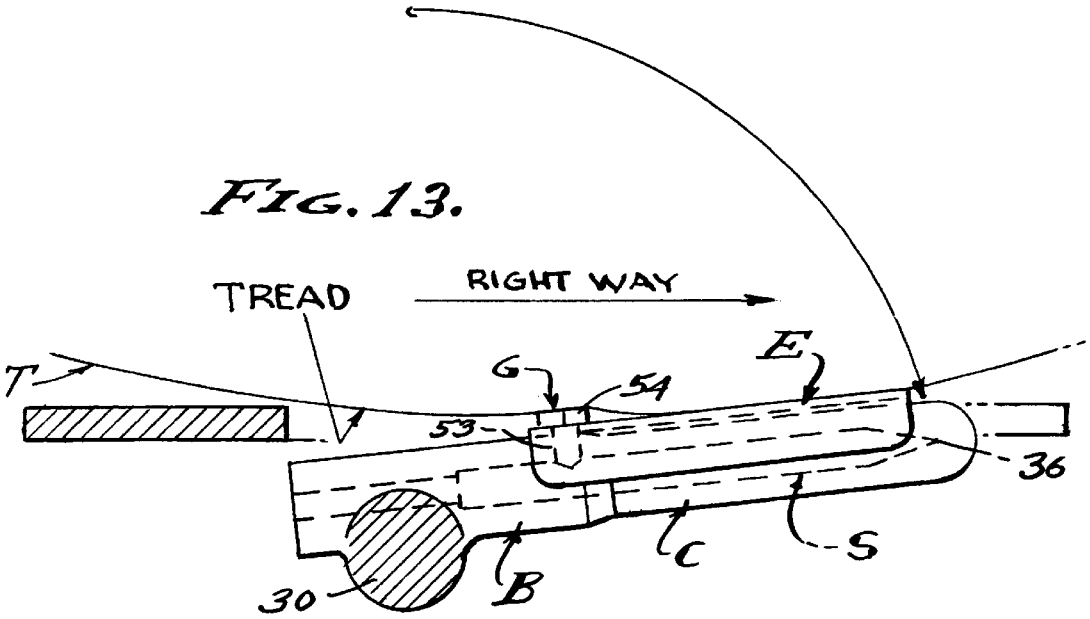
FIG. 14.
FIG. 15.
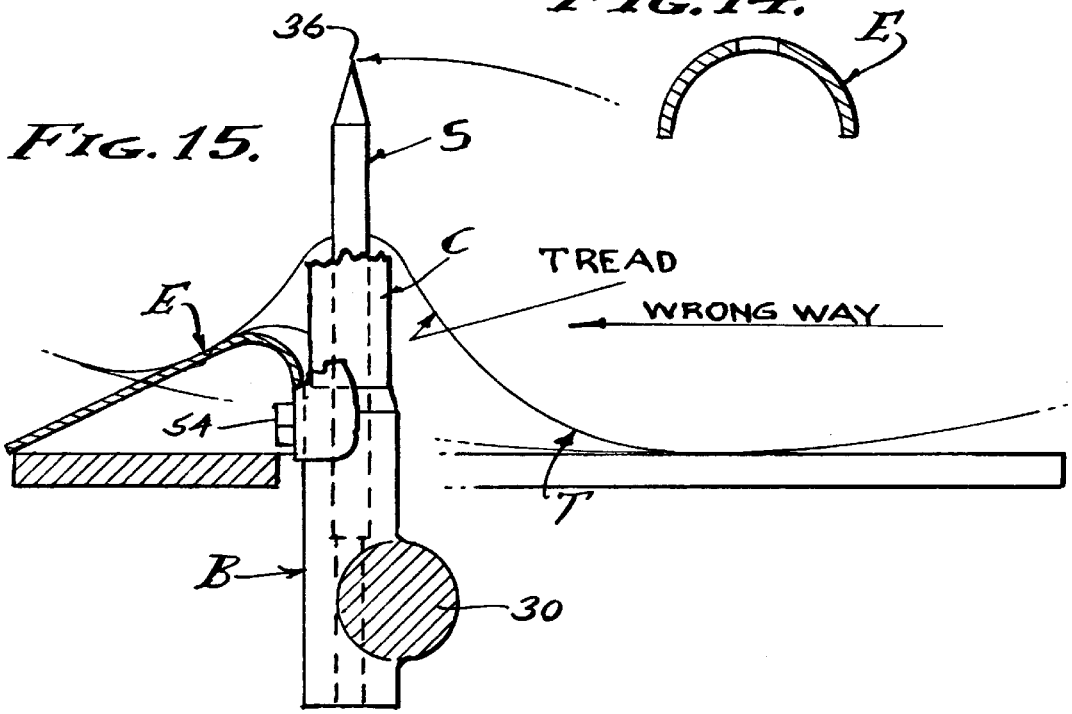

DRIVER INTIMIDATING PERSON FRIENDLY TIRE DESTRUCTIVE TRAFFICWAY CONTROLLER

BACKGROUND OF THE INVENTION

State of the art trafficway controllers are characterized by teeth raised into position where said teeth are inherently destructive to vehicular tires traveling in a prohibited direction of travel but also inadvertently dangerous to trespassers who may stumble onto these teeth.

There are three basic types of such controllers, 1) those which are counterbalanced or have spring biased depressible teeth, 2) those in which the teeth are mechanically lifted or lowered as by means of motor activation and having either a raised or retracted tooth position, and 3) those of the foregoing "2" type wherein the teeth are depressible from the raised position.

For those vehicles traveling in a permitted direction, the teeth are retracted or depressible and non-destructive and perhaps but not necessarily non-injurious to individuals contacting them. The teeth are sharp and potentially injurious to persons who might forcefully come into contact with them, when said teeth are in an exposed raised position. In other words, the prior art trafficway controllers of the type under consideration are not person friendly and could be injurious to tresspassers. Accordingly, it is a general object of this invention to provide a trafficway controller that is driver intimidating but person friendly and substantially non-injurious, having a passive mode permitting damage free vehicular traffic in one correct direction of travel, and an active destructive mode that destroys tires of vehicular traffic traveling in opposite directions and/or in a wrong-way direction of travel.

Trafficway controllers are metal fabrications comprised generally of a frame (above or below grade) that establishes a mounting channel for carrying intimidating teeth in a series extending transversely of a trafficway to be controlled. Accordingly, there is a plurality of teeth individually or modularly mounted in groups to extend upwardly above grade level and adapted to be depressed to or below grade level. Conventional state of the art teeth are pivotally mounted within a frame on a horizontally disposed pivotal axis, and motor driven or balanced by gravity or spring biased and/or mechanically operated so as to extend upwardly to a stopped intimidating tire destructive position against wrong way vehicular traffic, and also adapted to be collapsible, retracted or depressed by motor means actuated as by a card reader or by remote switch or radio control, to a non-destructive position for right-way vehicular traffic. Or the teeth can be slidably mounted so as to be raised and retracted. Characteristically, when in the vehicle driver intimidating position, the pointed teeth are exposed to pedestrians who may be using the trafficway for ingress or egress, whether authorized to do so or not, and these unprotected teeth are not person friendly. Therefore, it is an object of this invention to render the driver intimidating tire destructive teeth person friendly and substantially non-injurious to tresspassing pedestrians.

It is an object of this invention to improve the tire piercing capability of trafficway controllers, in order to ensure penetration through the reinforced tread of steel belted radial ply tires. Heretofore, rough-cut sheet steel teeth have sufficed for piercing conventional biased ply tires of the older original design. However, the present state of the art steel belted radial tires are much improved from the standpoint of durability and their resistance to tread penetration. And, it has been determined that roughly sharpened trafficway controller teeth do not ensure penetration of said improved present day state of the art steel belted tires. Therefore, the present invention provides a precision spike configuration, replacing the former crude tooth configuration, which is conveniently formed of a higher grade steel having properties to ensure piercing of said improved steel belted tire treads.

In view of the foregoing objectives, it is a primary object of this invention to cover the sharp driver intimidating tire destructive points of the spikes so as to protect pedestrians and to alternately expose the spikes to be engaged by a vehicle tire moving in said wrong traffic direction. Therefore, it is an object herein to provide a cover member that remains in its spike point covering protective position when engaged by a pedestrian, and a cover member that collapses, moves or is displaced from said spike so as to expose its point when forcefully engaged by a vehicle tire. In practice, the cover member is collapsible, movable or breakable from its protective position, temporarily or permanently, and preferably the latter in which case the cover member is structurally sound under normal loading that can be applied by pedestrian engagement, and collapsible, crushable, movable or frangible under severe loading of vehicular tire engagement applied by said wrong way vehicle traffic.

In carrying out this invention, the aforesaid preferred cover member is a sleeve or cap that is engaged over the spike point. For example, a sleeve type cover member that is retractile on the spike and held captive thereon, a sleeve type cover member that is collapsible or crushable, or preferably a cap type cover member that is frangible for breakaway removal from its protective position affixed over the spike point. Accordingly, the cap type cover member is an expendable part that is replaceable and secured in its working position by friction or by detent and preferably by toothed engagement onto the spike. Threaded engagement, shear-pin retention, or a positive lock shoulder engagement can also be emloyed, all as circumstances require.

Particularly, it is an object of this invention to provide a person friendly cover member and compatible spike configuration for trafficway controllers that is structurally sound to sustain normal pedestrian abuse while being person friendly, and that is collapsible or broken away when subjected to forceful wrong way vehicular tire traffic, whereby the cover member is displaced from its passive protective position over the spike point. In practice, the cap member is an expendable and preferably a replaceable injection molded plastic part that is collapsible or crushable and preferably strategically weakened for its determined effectiveness.

It is an object of this invention to provide a cover member and spike combination with spike point exposure means for removing said cover member from the spike point when subjected to heavy loads imposed by a vehicle tire rolling thereover in a wrong prohibited direction of travel, and also for ensuring retainment of said cover member over said spike point when subjected to loads imposed by bodily engagement of a tresspassing pedestrian. The spike point exposure means ensures penetration of the spike point through the cover member when subjected to said heavy tire loads by penatrability, crushability or collapsibility of or frangability of said cover member. The spike point exposure means is characterized by sharpness of the spike and/or inclined cam interengagement thereof with the cover member. It is the forceful tire engagement that operates the breakaway means for penetrating and/or shifting the cover member from the spike point and thereby completely exposing its damaging point.

Forward motion of a vehicle tire will tend to scuff the cover member from the spike member, and any braking of the vehicle will tend to drag the cover member forwardly along the spike member. Therefore, it is an object of this invention to eliminate and at least reduce said scuffing and said drag. Firstly, scuffing is reduced by providing a guard ahead of and isolating the butt end of the cover member from tire contact. Secondly, drag is resisted by anchoring the cover member to the spike member. And thirdly, wear is reduced and scuffing eliminated by a shield that isolates the cover from tire contact during right-way traffic. Accordingly, a set screw is provided to secure the spike member in working position, the head of which simultaneously forms an abutment and secures the shield over which the tire rides when depressing the spike member, thereby preventing scuffing and drag. In practice, the spike body is provided with a series of small forwardly faced teeth to anchor the overlying cover member in the passive working position; a ratchet effect for push-on retention of the cover member over the spike member.

In addition to the replacability of the cover member, it is also an object of this invention to provide for replacability of the spike member which is subject to damage upon severe impact when destroying a wrong-way tire. Accordingly, the spike per se is a simple rod of high quality steel sharpened at its active end, and with a normal butt end at its mounted base. In practice, a shouldered socket mounting is provided to secure and position the base of the spike member, there being a dual purpose set screw to secure the rod-shaped spike member in working position and to shield the cover member from initial scuffing by the vehicle tire.

SUMMARY OF THE INVENTION

There is a free direction of travel and a tire damaging direction of travel. In the free direction of travel the spikes are lowered or they are depressible. In the damaging direction the spike are raised so that the points thereof are immovable so as to pierce vehicle tires. The frangible cover member sustains pedestrian abuse but is immovable and thereby subjected to destruction by forceful tire engagement. When positively raised the spikes are damaging to vehicle tires traveling in a wrong direction. The primary object is to remove the cover members from the spike points when forcefully engaged as by vehicle tires traveling in a wrong or unauthorized direction. This can be accomplished by retracting the cover member, in which case the cover member can slide downwardly over the spike so as to bare and/or expose the spike point. However, it is preferred that the cover member be frangible and replaceable. In practice, the cover member is an inexpensive breakaway and replaceable part of simple configuration and which is compatible with the spike mounting thereof. The spike is also an inexpensive and releasable part devoid of complication. It is a fundamental object of this invention to provide a rugged assembly of expendable parts subject to destruction and/or damage, while eliminating features conducive to malfunction; bearing in mind that trafficway controller installations are subjected to the elements including water, ice and de-icing chemicals, sand, gravel, mud and all manner of packed debris, accompanied by neglect with little or no maintenance.

The foregoing and various other objects and features of this invention will be apparent and fully understood from the following detailed description of the typical preferred forms and applications thereof, throughout which description reference is made to the accompanying drawings.

THE DRAWINGS

FIG. 13 is a view similar to FIG. 11 and shows a shield embodiment that prevents tire tread contact with the protective cover.

FIG. 14 is an enlarged cross section of the shield shown in FIG. 13.

FIG. 15 is a view similar to FIG. 10 and shows the shield being fragmented and the tire tread pierced by the spike, the shield being displaced by wrong-way movement of the tire and its tread in the process of being pierced.

PREFERRED EMBODIMENT

Figures 1, 2, 3:
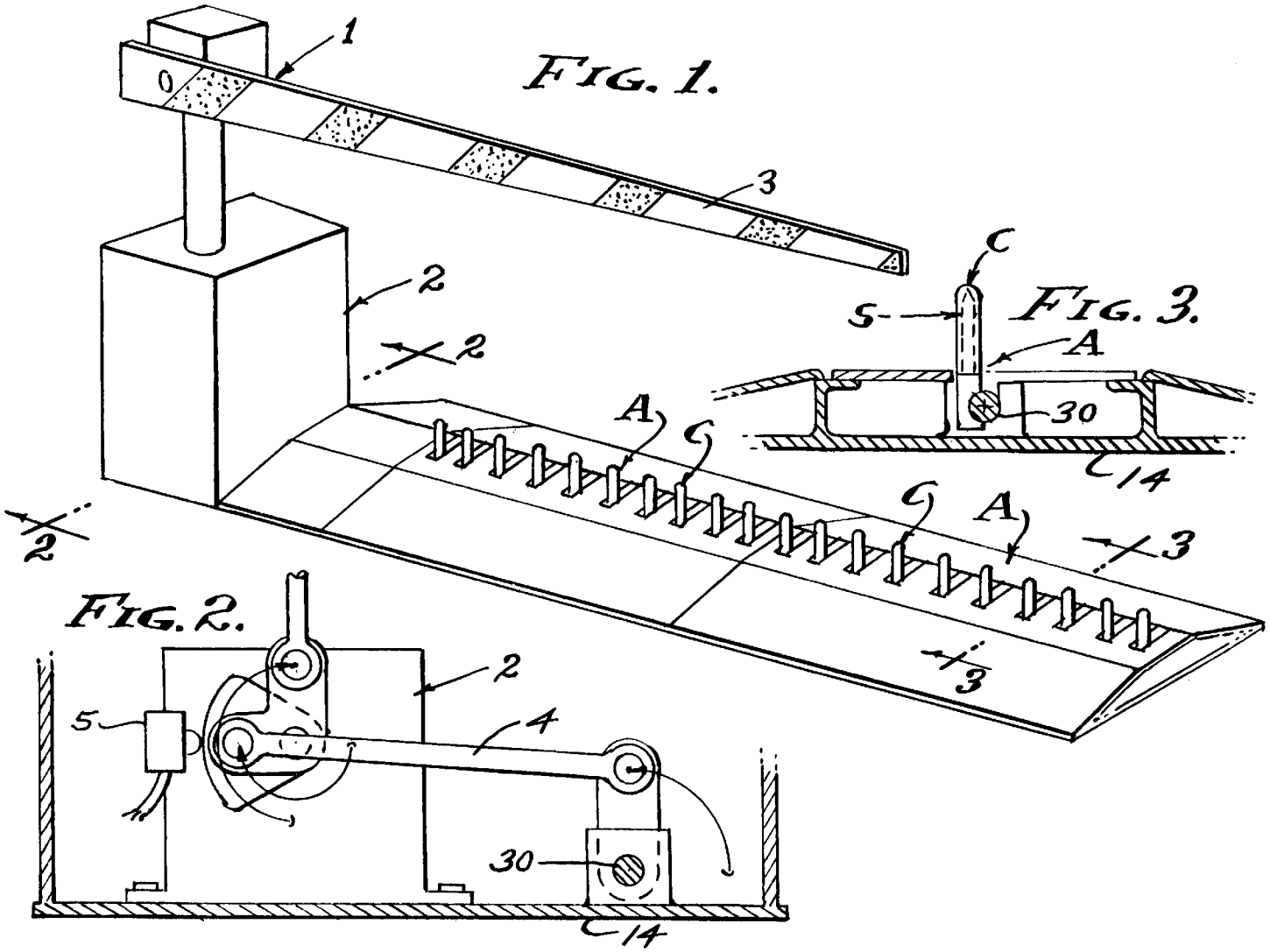
FIG. 1 is a perspective view of a motorized trafficway controller embodiment using the covered spikes of the present invention.
FIG. 2 is an enlarged view of the drive linkage taken as indicated by line 2—2 on FIG. 1. And, FIG. 3 is an enlarged sectional view of a deployed spike and cover taken as indicated by line 3—3 on FIG. 1.
Figure 4:
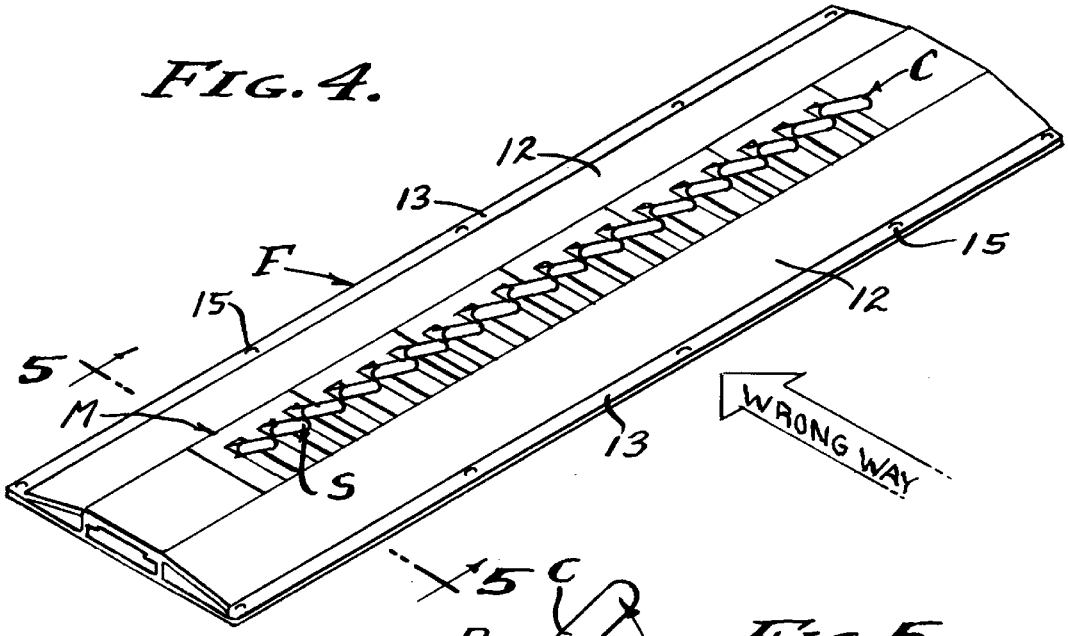
FIG. 4 is a perspective view of a low profile above grade trafficway controller embodiment using the covered spikes of the present invention.
Figure 5:
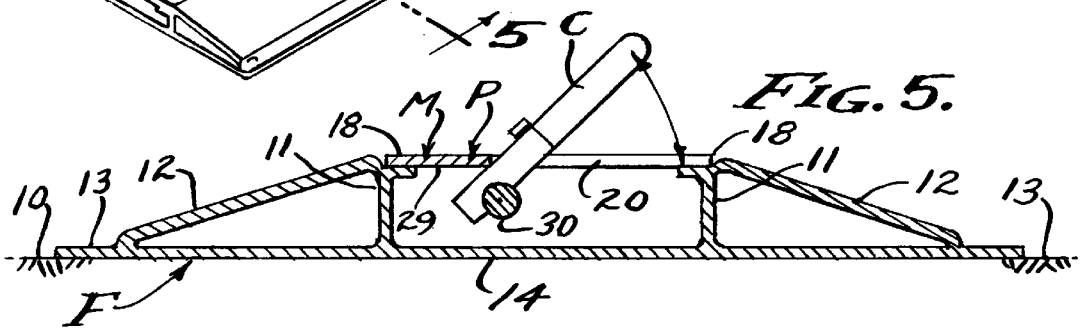
FIG. 5 is an enlarged sectional view of a deployed spike and cover taken as indicated by line 5—5 on FIG. 4.
Figure 6:
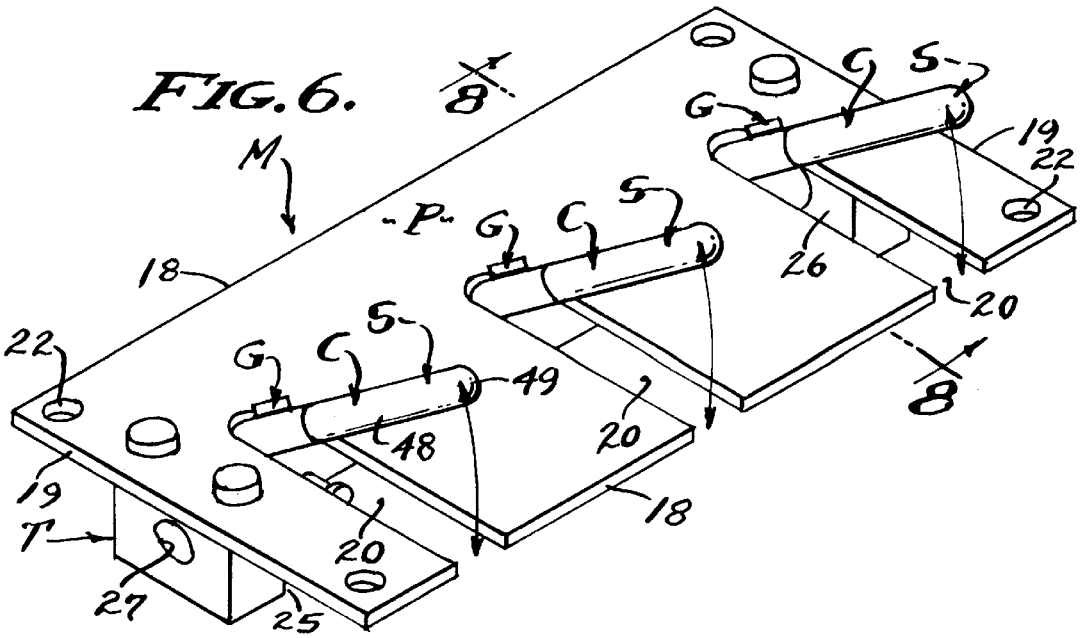
FIG. 6 is an enlarged perspective view of a replaceable barrier module that characterizes this invention.

Referring now to FIGS. 1–3 of the drawings, a typical preferred embodiment is shown wherein a motorized trafficway controller with retractile tire destructive shaft and spike assemblies A and an opening gate barrier 1 are coordinated to opertate in unison by a motor drive 2 that is cycled by cam controlled "stop" and "go" switches (not shown) responsive to the position of spikes S. The installation is above grade with assembled low profile modules exposing the shaft and spike assemblies A of person friendly driver intimidating configuration with the spikes S deployed for tire damage to wrong-way traffic. The gate barrier 1 is supported by the motor drive means 2 for positioning the spikes S and a semaphore arm 3 that is lifted when the shaft and spike assemblies A are retracted and alternately lowered as shown. The shaft and spike assemblies A and the motor drive 2 are adapted to be releasably coupled for replaceable engagement one by another.

A plurality of aligned tire tread piercing members S, herein referred to as "spikes", is carried on an individual shaft 30 rotatable in spaced journals and/or pillow-blocks supported by base member 14 and extended through slots in a top plate P, as shown. Each shaft 30 and attached spikes S forms an assembly A as will be described in the second embodiment shown in FIG. 7. In practice, this first embodiment is comprised of two assemblies A, each with ten spikes S (see FIG. 1) spanning a portion of the track width of three feet or more. There are male and female coupling members at opposite ends of each shaft 30 with a drive pin attachment and driving engagement from one shaft to another (not shown), providing a total track width of more than six feet (as shown) for a normal vehicle track width of approximately six feet. The prior art features of this motorized trafficway controller are disclosed is U.S. Pat. No. 4,318,075 issued Mar. 2, 1982.

The spikes S in this first embodiment revolve from an obscure retracted position (not shown) to a fully intimidating vertically disposed and destructive position as shown in FIGS. 1 and 3 of drawings. The linkage 4 and control switch 5 are shown in FIG. 2, illustrating by arrows the relative motions of the spike shaft 30 and the semaphore arm 3. Characteristically, the spike S is deployed vertically so as to be driver intimidating as well as tire tread damaging while covered for person protection. The vertically deployed spikes S pierce tire treads moving in either direction of travel.

Referring now to now to FIGS. 4–12 of the drawings, a low profile modular trafficway controller is shown for transverse installation across a vehicular drive, to freely pass vehicle traffic moving in a free-flow direction and to pierce a tire T moving in the wrong-way direction. The trafficway controller is a conspicuously intimidating structure superimposed over a flat pavement surface 10 so as to extend transversely of the drive and normal to the flow of traffic flow in either direction, and so as to present an intimidating barrier that prevents wrong-way flow of traffic by causing tire tread damage to wrong-way traffic flow. Traffic control is by means of retractile or depressible tire tread piercing members, or spikes as herein disclosed, that project so as to pierce the tires of wrong-way vehicles, said exposed spikes being Driver Intimidating as well as being Person Unfriendly. That is, the sharpened prior art teeth are exposed to trespassers who might wrongfully step upon or fall upon said teeth. It is these potentially person unfriendly teeth with which this invention is particularly concerned.

The trafficway controller shown throughout the drawings has a frame F of ramped channel configuration with spaced and parallel rails 11 to which the ramps 12 extend from the opposite margins 13 of a base 14. The rails 11 establish the height of the channel defined thereby to open upwardly. In practice, the ramps and base members 12 and 14 are planar sheet or plate steel of rectangular shape, and rise to form opposite inclined planes established by the rail members 11 of angular cross section, as shown. A feature is the horizontally coplanar inturned flanges of the rails 11, and the vertically disposed supporting flanges thereof that carry the ramps 12, and all of which is integrally welded along the edges of joinder. Fastener openings 15 are spaced along the margins 13 for the reception of hold-down fasteners; adhesive may be used between the base 14 and pavement slab 10 for securement, all as circumstances require.

A plurality of vehicle barrier modules M are employed in adjacent relationship for support by the frame F and to present spike members S in a uniform series spaced longitudinally thereof. The barrier modules M are alike and preferably identical so as to be replaceably interchangeable and reversible as well. A feature is the presentation of a plurality of spike members by each barrier module M, a group of several and preferably three spike member S equally spaced with respect to each other and also with respect to the spike members S of next adjacent barrier modules M.

Each barrier module M is comprised of a rectangular mounting plate P to span the coplanar flanges of the two rails 11 and of one foot length, in which case there is a center spike member S with two side spike members S spaced four inches therefrom. Accordingly, the mounting plate P has opposite edges 18 and is slotted normal to the one edge 18 at 20 (three places). The four corners of the plate P are drilled or punched at 22 for the reception of fasteners 23, for reversible securement to the rails 11. Accordingly, there is a frame or support station for each barrier module M to be mounted thereon, and each station has a rectangular fastener hole pattern for securment of the mounting plate P.

Spaced trunnions T are provided on an axis of rotation between opposite edges 18, there being a trunnion T depending from the margin of the plate P at each opposite end 19 thereof. As shown the pair of trunnions are of boss configuration removably screw fastened to the plate P and they present opposed faces 25 and 26 normal to said axis and normal to the plane of plate P. A feature is the pair of journal openings 27 and 28 disposed on said axis of rotation below the underside 29 of the said plate.

Referring now to the several spike members S that are journaled in the trunnions T to operate in unison, there is a mounting bar 30 to which the several spike members are attached as an integral assembly A. As shown, the mounting bar 30 is a rod or shaft of right cylinder form with its opposite projecting end portions freely rotatable in the journal openings 27 and 28 respectively. Axial thrust shoulders 29 at opposite ends of the bar 30 center the assembly A within the confines of the two spaced trunnions T.

The tire tread piercing members S are identical replaceable spikes carried by a base B secured to the mounting bar 30 and retractile to have a depressed position for free flow of traffic and a raised position for obstructing traffic. There is a spike member S aligned to operate within each slot 20 and projecting upwardly therethrough to be tire damaging and driver intimidating. A stop bar 35 welded to the bar 30 engages the bottom of the mounting plate P to limit the raised position of an acute tread piercing point 36, as shown. And the spike members S are stopped (for example) at a fourty-five degree incline. Each group of three spike members S is free to revolve in unison, as clearly shown.

A lift spring 37 yieldingly urges the spike members S of the assembly A into the extended visible intimidating position, and is accommodated between one end base member B and an adjacent trunnion T. In accordance with this invention a stop 38 extends from the bottom face of said adjacent trunnion T to engage the anchor leg of the coil spring 37 that surrounds the mounting bar 30 slidable over the end of bar 30. The active leg of the spring 37 yieldingly engages a pin 39 projecting at and beneath the base B and radially from the bar (see FIG. 4) 30 to urge it toward a raised or lifted position of the spike members S, stopped by the aforesaid stop 35.

In accordance with this invention there is a destructable person protective cover means C that renders the spike members S person friendly by sheathing the sharp point 36 thereof during the passive but intimidating condition of the trafficway controller. That is, there is a cover means C installed on each intimidating point 36, rendering said points ineffective and potentially non-injurious. The cover means C is movable, penetrable or destructable by tire engagement force, exposing the point 36 for its damaging affect, the cover means C being protective of a person coming into contact therewith when applying only moderate force. In other words, the means C will not expose the spike member point 36, nor will it be moved or destructed with the application of moderate force. Only when subjected to severe force as will be applied by vehicle tire engagement will the cover means C be moved, penetrated or destructed. For example, penetration and/or swedging through the cover means C (see FIG. 10) deforms the same from its protective position over the point 36 of said spike member.

Figure 7:
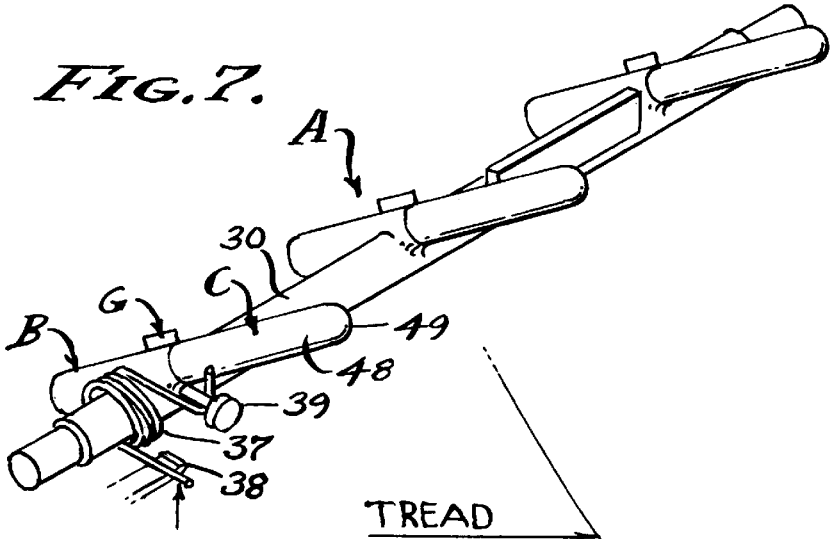
FIG. 7 is a perspective view of the shaft and spike assembly removed from the mounting plate shown in FIG. 6.
Figure 8:
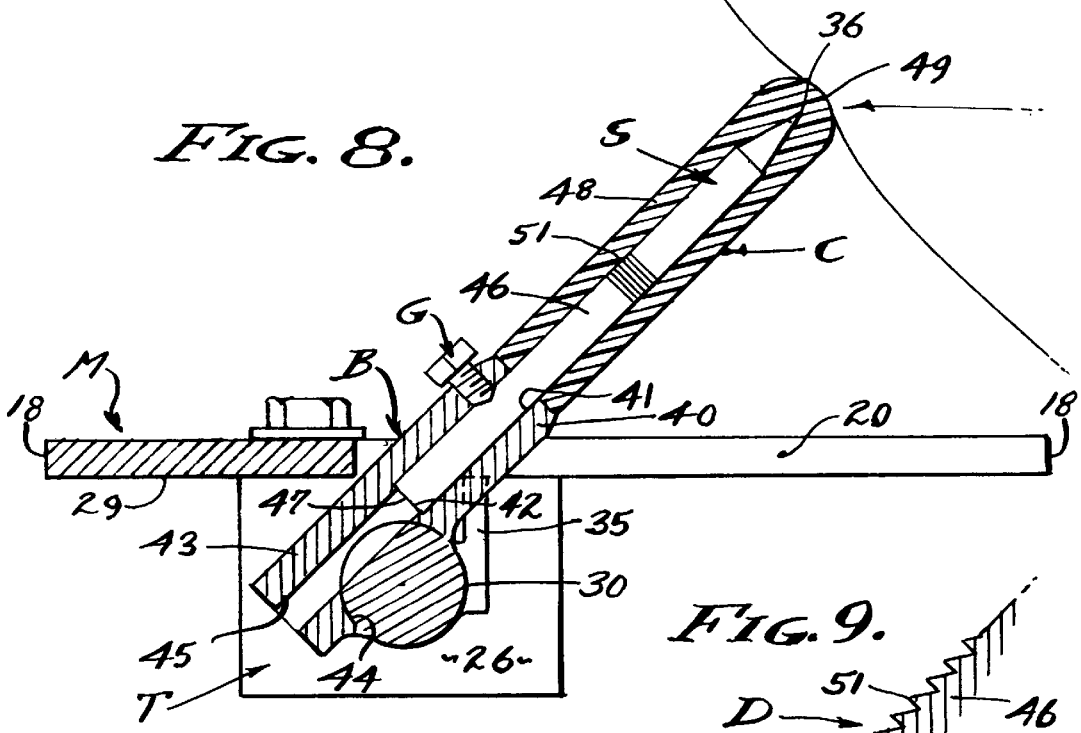
FIG. 8 is an enlarged sectional detailed view taken as indicated by line 8—8 on FIG. 6.

Referring now to the mounting bar assembly A as shown in FIG. 7, the plurality of bases member B are symetrically and equally spaced along the mounting bar 30 which has shouldered portions projecting equally from its opposite ends. Each base member B is an elongated right cylinder part with a concentric socket 41 open at an outer end face of outer end portion 40 and terminating approximately midway therein at a shoulder 42 that stops and positions the spike member S. The inner end portion 43 is carried by the mounting bar 30 to project the spike mounting axis substantially radially therefrom, as clearly shown. In practice, the base member B is welded to a side of the mounting bar 30, with its axis tangent to the circumference of said bar, the base member being formed with a transverse concavity 44 complementary to and fitting the bar circumference. After the base member B is fastened to the bar, by whatever means, the inner end portion 43 is counterbored so as to provide a knockout passage 45 in order to provide access to drive out a damaged spike member S. The axes of the plurality of bases member B are disposed in a common plane tangent to the top periphery (as shown) of the mounting bar 30. And, it is to be understood that the number of bases member B and attached spike members S carried thereby can be varied as circumstances require to traverse the width of a trafficway, whether it is a modular unit as described or a full width coupled unit mechanically lifted and retracted, wherein the mounting bar or bars 30 substantially traverses the width of the trafficway to be controlled.

In accordance with this invention, the spike member S is a slender pointed shaft fabricated of durable material and preferably a high tensile steel such as S.A.E. 4130 or the like. In practice, the physical properties of the spike body material are such as to be equal to or superior than the tire tread materials that will be encountered and penetrated thereby. And, the configuration of the spike point or apex 36 is such as to seek and swedge through the weak areas and/or the mesh openings of the circumferential tire tread breaker-band for effective penetration thereof. Said mesh openings are initially miniscule and resistant to blunt tooth points, however the breaker-band mesh is swedged apart and entered through by the acutely sharp spike as herein disclosed. That is, an acutely sharp and durable effective spike point 36 is provided. In carrying out this invention, a spike body 46 of 0.3125 inch dia. and of 4.000 inch length is employed. The inner butt end 47 is normal to the spike axis and the outer point end is conically turned at an included acute angle within the range of approximately 20° to 60° and preferably at an included swedge angle of 30° terminating at the point or apex 36.

In accordance with this invention, cover means C is provided to isolate the sharp point 36 of the spike S from a person coming upon the trafficway controller. The cover means C is a cap-shaped cover member fabricated to be movable or of a relatively soft penetrable and/or destructable material and preferably an Acrylic Butyle Styrene (ABS) or like plastic. In practice, the physical properties of the cover member cap are such as to be resistant to or such as to sustain normal loading as may be, but not necessarily, applied by the engaged contact of a person, such as a wrongful tresspasser or unauthorized person stepping or falling thereupon. The body material of the cover member can be a foamed plastic of a durometer having a cushioning effect, protection afforded by the cover member cap being commensurate with the physical properties of the solid or foamed plastic and controlled by the durometer and wall thickness thereof overlying the spike point 36. As shown, the cover member includes an open ended sleeve 48 that is coextensively and contiguously pressed onto and surrounds the shaft body 46 of the spike member S, and which for example is 0.312 inch wall thickness; it being understood that the wall thickness will vary with respect to the physical properties of the plastic material employed, in order to provide the penatrability and/or destructability required. The open rearward end of sleeve 48 is stopped by and positioned by the forward end face of the base B that presents a stop shoulder surrounding the spike body 46. And also as shown, the cover member includes a crown 49 that closes the outer end of said cap and that overlies and/or occludes the point or apex 36 of the spike member S. In practice, the distal end crown 49 is of increasing wall thickness, for example to more or less 0.125 inch at the center axis thereof, as shown. The crown 49 is in the form of a hemispherical front wall with a circumference tangent to the outside diameter of the sleeve 48. The interior wall of the crown 49 is contiguous to the cone-chaped point 36 of the spike member S, and the sleeve 48 is press fitted onto the shaft of the spike and retained thereby.

Figure 12:
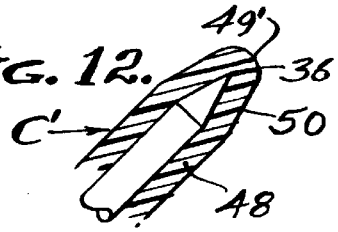
FIG. 12 is a fragmentary sectional view of the spike point as it is protected by a second embodiment of the person protective cover of the present invention.
Figure 11:
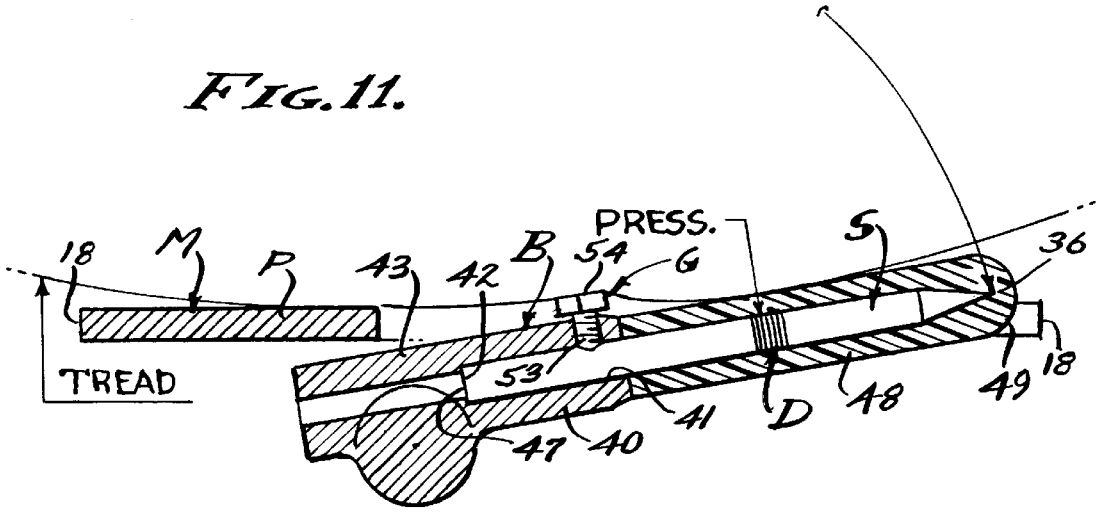
FIG. 11 is a view similar to FIGS. 8 and 10 illustrating the function of the cover and spike when responding to right-way vehicular traffic.

A second and more intimidating point cover embodiment is shown in FIG. 12 wherein the size of the crown 49' is substantially reduced and less than the full diameter of the sleeve 48, and with a conical outer wall 50 simulating a point within the cover member C'. The wall thickness of the crown 49' and wall 50 are controlling the same as hereinabove described.

Figure 9:
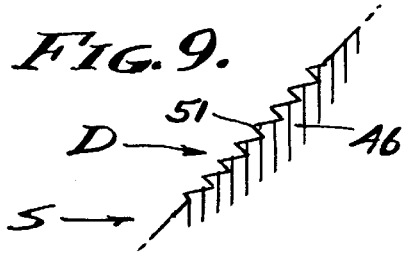
FIG. 9 is an enlarged fragmentary view of the cover anchor means on the surface of the spike.
Figure 10:
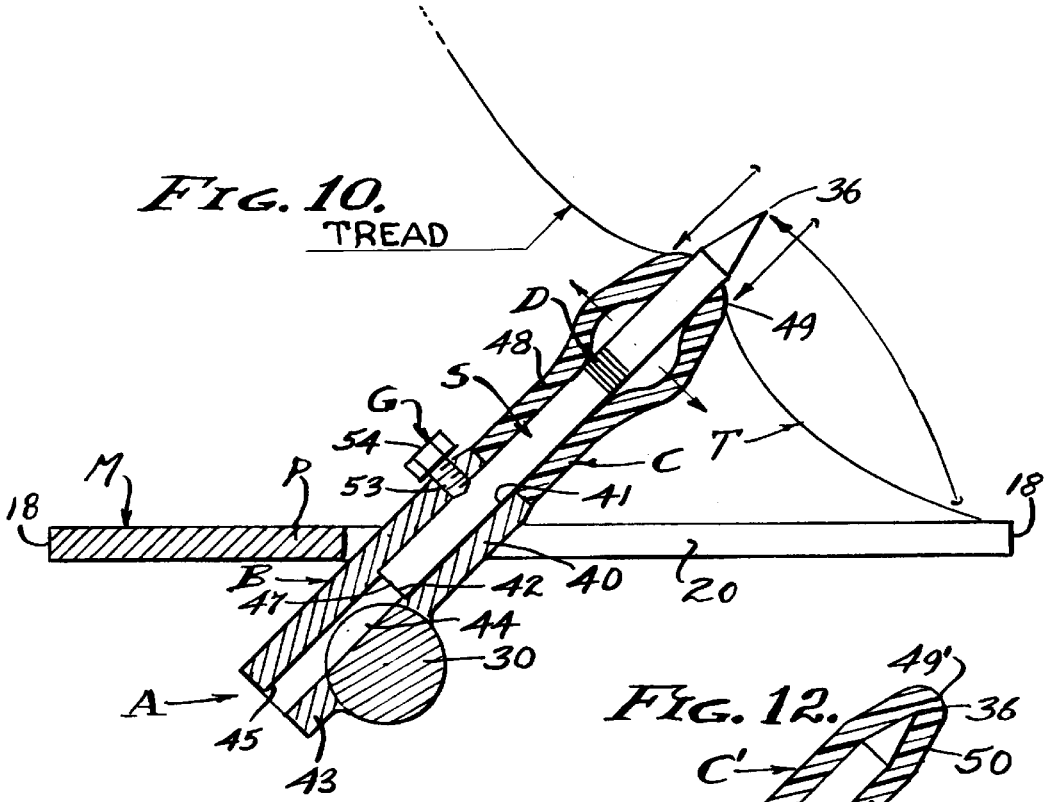
FIG. 10 is a view similar to FIG. 8 illustrating the function of the cover and spike in the process of piercing a tire tread.

Retainment of the cover member of cover means C on the spike member S is ensured by anchor means D that supplements the frictional retainment of the press fit hereinabove described. The anchor means D can be an adhesive and preferably is mechanical and comprised of rearwardly faced teeth 51 formed in or on the periphery of the cylindrical spike body 46 as by knurling, thereby upsetting and raising the tooth points so as to increase pressured engagement with and to bite into the inner diameter surface of the cover member sleeve 48. In practice, a plurality of sharp tooth rings face rearwardly as shown in FIG. 9, said plurality or group of rings being placed intermediate the spike point 36 and butt end 47 of the embraced spike body, and underlying the approximate area of tire tread engagement, whereby pressure exerted by forceful tire engagement forces the teeth into buried engagement into the inner sleeve wall of the cover means C. Accordingly, any scuffing of the tire tread along the cover member does not shift or move said cover member from its installed position over the spike member S.

The stopped joinder of the open end of the cover member of means C with the forward shoulder of the base member B is protected by a guard G in the form of a dual purpose set screw 53 that positions the spike member S in the base socket 41 and also forms an abuttment. As shown, the guard G is the head 54 of the set screw 53 and located close to the line of stopped joinder between the cover member and forwardly faced shoulder of base member B. Accordingly, a tire tread rolling over the cover and spike assembly in the right direction of travel does not engage nor contact said line of joinder, so that there is no forward scuffing affect at said joinder.

An additional protection of the cover member of cover means C is provided with a shield E as shown in FIGS. 13–15 of the drawings. In accordance with this invention, the shield E is secured over the cover member by the multipurpose guard screw 53 hereinabove described. As shown in FIG. 13, the spike S is depressed by a right-way movement of tire T, in which case the tire tread is not adversely affected by the spike S which is simply depressed as shown. Scrubbing of the cover means C is eliminated by the overlying shield E secured in place by the aforesaid head 54 of the screw 53. In practice, the shield E is a stiffened shell of maleable heavy gage low carbon steel of semi-circular cross section (see FIG. 14) fitted to the arcuate exterior of the member base B so as to project over the extended cover of means C and the protected spike S. The tire T rolling forward in a right direction of travel does not contact the cover means C, but rather rolls over the shield E only to depress and the same as shown.

In the wrong-way direction of travel shown in FIG. 15 the shield E is deformed and/or deflected away from and thereby exposing the cover member so as to subject the same to subsequent penetration and/or destruction, thereby exposing the spike point 36. Referring now to FIG. 15, the spike S is shown deployed to its intimidating vertical position piercing through a wrong-way moving tire T, penetrating the tread thereof. Rolling movement of the tire T deforms and destroys the frangible shield E, removing it from its point protective position as shown generally in FIG. 15, thereby exposing said spike S. As shown, the spike protecting portion of the frangible cover means C is broken away from the supported base end thereof, thereby exposing the active tire penetrating point 36 for its tire destructive piercing function.

Figure 16:
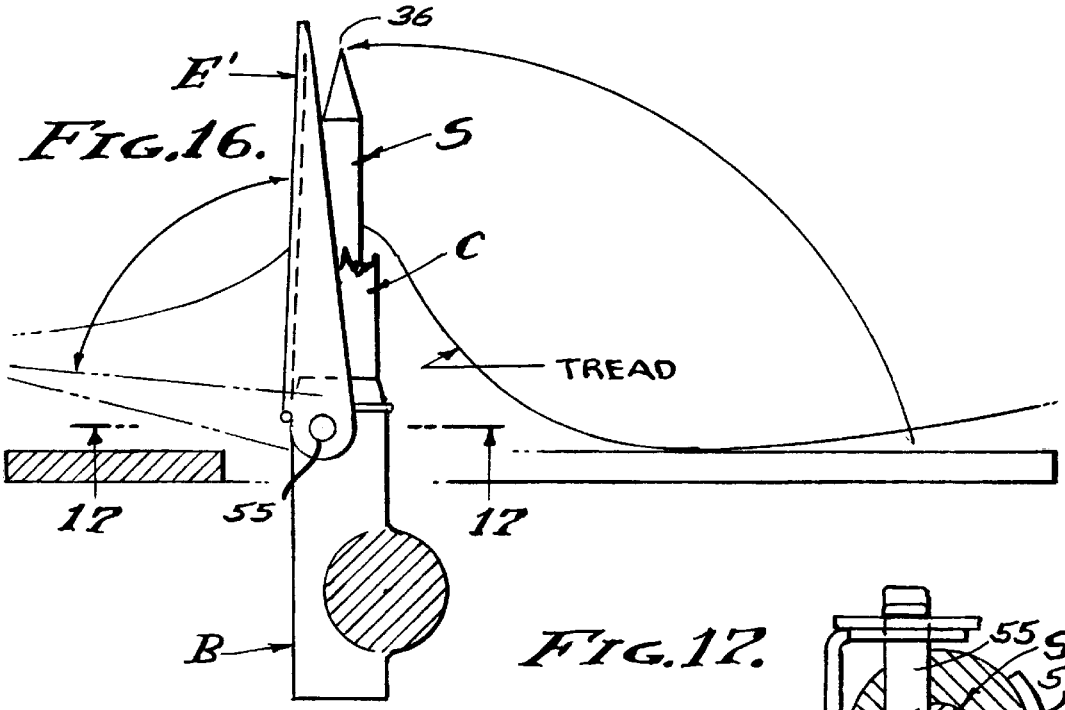
FIG. 16 is a view similar to FIGS. 13, and 15 and shows a "snap-back" embodiment of the shield that prevents tire tread contact with the protective cover.
Figure 17:
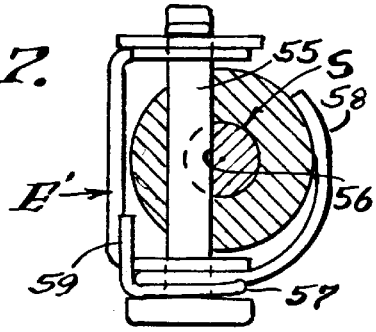
FIG. 17 is an enlarged cross section taken as indicated by lines 17—17 on FIG. 16 illustrating the spring return.

Referring now to FIGS. 16 and 17 of the drawings, a modified version of the FIG. 13–14 embodiment is shown, wherein the shield E' revolves from its spike protective position when subjected to the force of wrong-way tire tread movement. In this modified enbodiment the cover member of the cover memans C is provided with a shield E' pivotally secured over the cover member by a pivot pin 55 extending horizontally through the base member B and engaged with a notch 56 in a side of the shank of the spike S, thus serving two purposes. As indicated by phantom lines in FIG. 16, the shield E' is depressed by a wrong-way movement of the tire T, in which case the tire tread is adversely affected by the spike S which punctures the tire as shown. The shield E' remains as shown in FIG. 16 until forcibly pressed and/or rotated by tire tread engagement. The shield E' is yieldingly held in its protective position next adjacent to cover member C over the spike S by a spring 57, shown in FIG. 17 as comprised of a coil surrounding the pin 55 and captured in place by the head of the pin. One fixed leg 58 of the spring is anchored under the base member B, and the other active leg 59 yieldingly biases the shield E' into its protective position.

Figure 18:
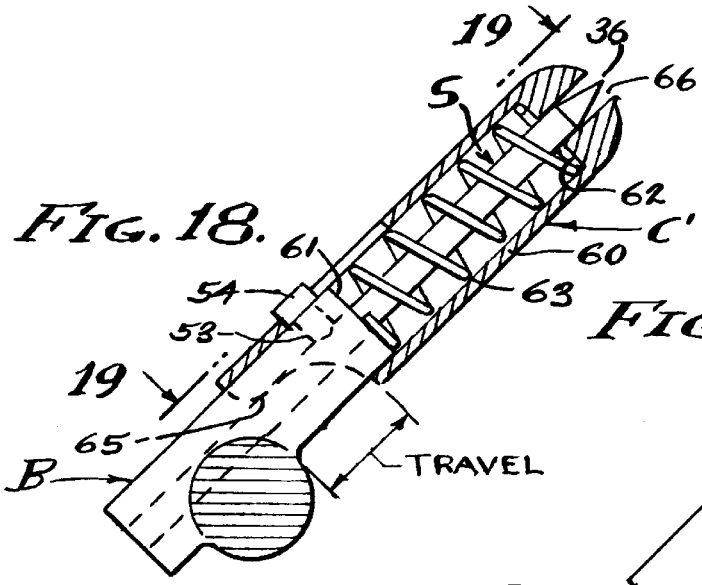
FIG. 18 is a view similar to a portion of FIG. 8 and shows a depressible spike, which can be vertically disposed as well as inclined as shown. And, FIG. 19 is a plan view taken as indicated by ine 19—19 on FIG. 18 and illustrates means to limit depression of the cover.
Figure 19:
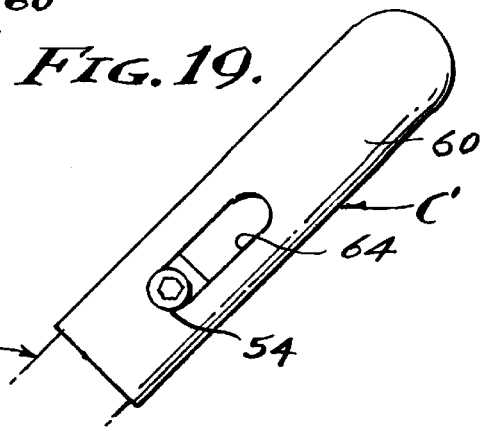

Referring now to FIGS. 18 and 19 of the drawings, another embodiment is shown wherein the cover member of the cover means C' depressibly slides rectilinearly over the spike S, so as to alternately cover and expose the sharp point 36 thereof. In this depressible embodiment, the cover member is a cylindrical sleeve 60 guided by and over the base member B and the outer portion of spike S. Characteristically, the sleeve 60 is open at its inner-lower end so as to slide freely over a spring seat 61 at the terminal end of the body of base member B. And, the sleeve 60 is provided with a spring seat 62 at its outer-open end, the seats being opposed and between which there is a compression spring 63, whereby the sleeve 60 is yieldingly depressible and telescopes over the base member B. Depression and extension of the sleeve 60 is limited by a longitudinal slot 64 in the wall of the sleeve 60, the slot being engaged over the head 54 of the screw 53, preferably a round head set-screw, that also secures the spike S. One side of the sleeve 60 is provided with clearance 65 that accomodates the supporting shaft 30. In practice, the outer upper end of the sleeve 60 is open at 66 to freely pass and expose the spike point 36.

Having described only the preferred forms and applications of my invention, I do not wish to be limited or restricted to the specific details herein set forth, but wish to reserve to myself any modifications or variations that may appear to those skilled in the art as set forth within the limits of the following claims.

I claim:

1. A vehicle trafficway controller disposed transversely of a trafficway surface over which vehicular traffic is to pass, with a traffic free-flow condition and a person friendly driver intimidating wrong-way traffic condition for causing vehicle tire tread damage, and including:

a frame rotatably supporting a shaft that carries a base member with a socket on an axis projecting tangentially from said shaft and with a bottom shoulder, a vertically retractile tire tread piercing member received in the socket and seated upon said bottom shoulder and secured in position by said bottom shoulder and having a tread piercing point shiftable from an extended position above said trafficway surface to a retracted position below said surface, a movable person protective cover means for engaging over and isolating the point of the tire tread piercing member from contact with and injury to a person when positioned in said person friendly driver intimidating wrong-way traffic condition, and forcefully movable from and exposing said tire tread piercing point to a tire tread rolling thereover in said person friendly driver intimidating wrong-way traffic condition, and means for alternately positioning the tire tread piercing member is said extended and retracted positions.

2. The vehicle trafficway controller as set forth in claim 1, wherein the tire tread piercing member is received in said socket and positioned upon said bottom shoulder, there being a knockout passage through the base member and opening at said bottom shoulder for removal of the tire tread piercing member from the base member.

3. The vehicle trafficway controller as set forth in claim 1, wherein the movable person protective cover member is a cap-shaped part of a collapsible material peneterable by the point of the tire tread piercing member for collapse exposing said point to the tire tread.

4. The vehicle trafficway controller as set forth in claim 1, wherein the movable person protective cover member is a cap-shaped part of frangible material having physical properties for remaining intact subject to person contact and for breakaway from the point of the tire tread piercing member subject to forceful tire tread contact.

5. The vehicle trafficway controller as set forth in claim 1, wherein the tire tread piercing member is received in the socket and positioned upon said bottom shoulder, and wherein the movable person protective cover is a cap-shaped part having a sleeve slidable onto the tire tread piercing member.

6. The vehicle trafficway controller as set forth in claim 1, wherein the tire tread piercing member is an elongated cylindrical body having an acute point for swedging through said tire tread, and wherein the movable person protective cover member is a cap-shaped part with a sleeve slidable onto the body of the tire tread piercing member, there being an anchor means in the form of at least one tooth formed on the body of the tire tread piercing member and faced rearwardy for securing the movable person protective cover member onto the tire tread piercing member.

7. The vehicle trafficway controller as set forth in claim 1, wherein the tire tread piercing member is an elongated cylindrical body having an acute point for swedging through said tire tread, and wherein the movable person protective cover member is a cap-shaped part with a sleeve slidable onto the body of the tire tread piercing member, there being an anchor means in the form of a plurality of ring-shaped teeth formed on the periphery of the body of the tire tread piercing member and faced rearwardly for securing the movable person protective cover member in position on the tire tread piercing member.

8. The vehicle trafficway controller as set forth in claim 1, there being a shield of maleable material positioned to overlie the destructable person protective cover member when in said retracted traffic free-flow condition, and positioned for deflection when in said extended wrong-way traffic condition by forceful engagement of a tire tread thereagainst.

9. The vehicle trafficway controller as set forth in claim 1, wherein a shield is rotatably pivoted on the base member to overlie the movable person protective cover member and pivotal away therefrom by forceful engagement of a tire tread thereagainst when in said wrong-way traffic condition.

10. The vehicle trafficway controller as set forth in claim 9, wherein the shield is an elongated semi-cylindrical cross section of rigid material depressed and overlying the movable person protective cover member when in said retracted traffic free-flow condition, and pivoted away therefrom by forceful engagement of a tire tread thereagainst when in said wrong-way traffic condition.

11. The vehicle trafficway controller as set forth in claim 1, wherein the movable person protective cover means is a shield slidable over the tire tread piercing member and onto the base member for exposing said tire tread piercing member, and a spring yieldingly extending the shield over the tire tread piercing member.

12. The vehicle trafficway controller as set forth in claim 1, wherein the movable person protective cover member is a shield in the form of a sleeve slidable over the tire tread piercing member and onto the base member for exposing said tire tread piercing member, a set-screw through the base mamber securing the tire tread piercing member and having a head operable in a slot of the sleeve limiting movement of said sleeve, and a spring operable between the base member and sleeve yieldingly extending the shield-sleeve over the tire tread piercing member.

13. The vehicle trafficway controller as set forth in claim 1, wherein the shaft carries a multiplicity of base members and each with a cylindrical socket on an axis projecting tangentially from said shaft and each with a bottom shoulder, each tire tread piercing member having a cylindrical body received in said socket and positioned upon a said bottom shoulder, wherein the movable person protective cover member is a cap-shaped sleeve slidable onto the cylindrical body of a tire piercing member, and there being a shield of maleable material positioned by a fastener to each base member to overlie a movable person protective cover member when in said retracted traffic-free-flow condition, and positioned for deflection when in said extended wrong-way condition by forceful engagement of a tire tread thereagainst.

14. The vehicle trafficway controller as set forth in claim 1, wherein the shaft carries a multiplicity of base members and each with a cylindrical socket on an axis projecting tangentially from said shaft and each with a bottom shoulder, each tire tread piercing member having a cylindrical body received in a said socket and positioned upon a said bottom shoulder, wherein the movable person protective cover member is a cap-shaped sleeve slidable onto the cylindrical body of a tire tread piercing member, there being an enlarged semi-cylindrical cross-sectioned shield of maleable material positioned by a fastener to each base member to overlie the movable person protective cover member when in said retracted traffic free-flow condition, and positioned for deflection when in said extended wrong-way traffic condition by forceful engagement of a tire tread thereagainst.

15. A modular vehicle trafficway controller disposed transversely of a trafficway surface over which vehicular traffic is to pass, with a traffic free-flow condition and a person friendly driver intimidating wrong-way traffic condition for causing vehicle tire tread damage, and comprised of:

a frame having spaced parallel rails extending transversely of the trafficway, and ramps extending from the trafficway surface to said rails, a plurality of adjacent barrier modules secured to said spaced parallel rails to extend transversely of the trafficway, and each barrier module including;

a mounting plate extending between said rails and with transversely spaced trunnions on a common axis beneath said plate, and an upwardly open slot therethrough along one of said rails, a shaft rotatably supported by and extending between said transversely spaced trunnions and carrying a base member with a socket on an axis projecting tangentially from said shaft and with a bottom shoulder, a tire tread piercing member received in a said socket and seated upon a said bottom shoulder therein and secured in position by a fastener and having a tread piercing point spaced radially from said shaft and to project through said slot, a movable person protective cover member over and isolating the point of the tire tread piercing member from contact with and injury to a person when positioned in said person friendly driver intimidating wrong-way traffic condition, and forcibly movable from and exposing said tread piercing point to a tire tread rolling thereover in said person friendly driver intimidating wrong-way traffic condition, and means for alternately positioning the shafts and tire tread piercing members of said adjacent barrier modules in said extended and retracted positions.

16. The modular vehicle trafficway controller as set forth in claim 15, wherein each module shaft carries at least one base member with a said socket and with a said bottom shoulder, and wherein at least one said tire tread piercing member is received in said socket and positioned upon said bottom shoulder therein, there being a knockout passage through said base member and opening at said bottom shoulder for removal of the tire tread piercing member from the base member.

17. The modular vehicle trafficway controller as set forth in claim 15, wherein each movable person protective cover means is a cap-shaped part of frangible material having physical properties for remaining intact subject to person contact and for breakaway from the point of the tire tread piercing member subject to forceful tire tread contact.

18. The modular vehicle trafficway controller as set forth in claim 15, wherein each module shaft carriers at least one base member with a said socket and with a said bottom shoulder, the at least one tire tread piercing member being received in said socket and positioned upon said bottom shoulder therein, and wherein said movable person protective cover means is a cap-shaped part having a sleeve slidable onto a tire tread piercing member.

19. The modular vehicle trafficway controller as set forth in claim 15, wherein each module shaft carries at least one base member with a cylindrical socket and with a said bottom shoulder, the at least one tire tread piercing member having a cylindrical body received in said cylindrical socket and positioned upon a said bottom shoulder therein, wherein said movable person protective cover means is a cap-shaped sleeve slidable onto the cylindrical body of the tire tread piercing member, and wherein a shield of maleable material is positioned by a fastener to the base member to overlie the movable person protective cover means when in said retracted traffic free-flow condition, and positioned for deflection when in said extended wrong-way traffic condition by forceful engagement of a tire tread thereagainst.

20. A motorized vehicle trafficway controller disposed transversely of a trafficway surface over which vehicular traffic is to pass, with a traffic free-flow condition and a person friendly driver intimidating wrong-way traffic condition for causing vehicle tire tread damage, and comprised of:

a frame member having spaced parallel rails extending transversely of the trafficway and ramps extending from the trafficway surface to said rails, and having transversely spaced trunnions supported on said frame and on a common axis beneath a top plate and with a multiplicity of transversely spaced upwardly open slots along one of said rails, a shaft rotatably supported by the spaced trunnions on said axis extending transversely of the trafficway and carrying a base member with a socket on an axis projecting tangentially from said shaft and with a bottom shoulder, a tire tread piercing member having a tread piercing point spaced radially from said shaft and received in said socket and positioned upon said bottom shoulder therein, there being a knockout passage through said base member and opening at said socket shoulder for removal of the tire tread piercing member from the base member, a movable person protective cover means over and isolating the point of the tire tread piercing member from contact with and injury to a person when positioned in said person friendly driver intimidating wrong-way condition, and forcefully movable from and for exposing said tread piercing point to a tire tread rolling thereover in said person friendly driver intimidating wrong-way traffic condition, and motor means for alternately positioning the shaft and said at least one tire tread piercing member between a passive retracted position and said person friendly driver intimidating wrong-way traffic condition.

21. The motorized vehicle trafficway controller as set forth in claim 20, wherein the base member is carried on an axis projecting tangentially from said shaft, the at least one tire tread piercing member being received in said socket and seated upon said bottom shoulder therein and secured in position by a fastener.

22. The motorized vehicle trafficway controller as set forth in claim 20, wherein the movable person protective cover means is a cap-shaped part of frangible material having physical properties for remaining intact subject to person contact and for breakaway from the point of the tire tread piercing member subject to forceful tire tread contact.

23. The motorized vehicle trafficway controller as set forth in claim 20, wherein the shaft carries a multiplicity of base members and each with a said socket and with a said bottom shoulder, a tire tread piercing member being received in each socket and positioned upon said bottom shoulder therein, and wherein each movable person protective cover means is a cap-shaped part having a sleeve slidable onto a tire tread piercing member.

24. The motorized vehicle trafficway controller as set forth in claim 20, wherein the shaft carries a multiplicity of base members and each with a cylindrical body and with a said socket and with a said bottom shoulder, the tire tread piercing member having a cylindrical body received in the socket and positioned upon said bottom shoulder, wherein the movable person protective cover means is a cap-shaped sleeve slidable onto the cylindrical body of the tire tread piercing member, and wherein a shield of maleable material is positioned by a fastener to each base member to overlie said movable person protective cover means when in said traffic free-flow condition, and positioned for deflection when in said wrong-way traffic condition by forceful engagement of a tire tread thereagainst.

* * * * *